United States Patent [19]

Crosslen

[11] Patent Number: 4,478,338

[45] Date of Patent: Oct. 23, 1984

[54] DISPLAY DEVICE OF THE TYPE HAVING RACKS ARRANGED IN SHINGLED FASHION

[75] Inventor: Louis J. Crosslen, Grafton, Wis.

[73] Assignee: Frank Mayer & Associates, Inc., Grafton, Wis.

[21] Appl. No.: 448,396

[22] Filed: Dec. 9, 1982

[51] Int. Cl.[3] ..... A47F 7/00

[52] U.S. Cl. ..... 211/490; 312/322; 312/42; 211/128

[58] Field of Search ..... 211/490, 128, 151, 162, 211/94, 94.5; 312/42, 322, 323

[56] References Cited

U.S. PATENT DOCUMENTS

| | | | |
|---|---|---|---|
| 1,189,371 | 7/1916 | Lyons | 312/322 X |
| 1,931,403 | 10/1933 | Connor | 312/42 |
| 2,294,689 | 9/1942 | O'Reilly | 312/322 X |
| 2,513,595 | 7/1950 | Stewart | 211/59.3 |
| 2,769,551 | 11/1956 | Just | 211/151 X |
| 4,121,717 | 10/1978 | Hensel, Jr. | 211/94 X |
| 4,314,734 | 2/1982 | Grunert | 312/322 |
| 4,387,810 | 6/1983 | Crosslen | 211/128 X |
| 4,396,237 | 8/1983 | Henry | 211/49 D X |

*Primary Examiner*—Ramon S. Britts
*Assistant Examiner*—Sarah A. Lechok
*Attorney, Agent, or Firm*—James E. Nilles

[57] ABSTRACT

A point of purchase merchandise display assembly including a plurality of merchandise racks arranged in shingled relationship with one another, the racks are mounted for generally vertical sliding movement in the cabinet between a lower merchandise loading position and an upper display position. This sliding movement is accomplished by a pin and groove connection between the racks and the side walls of the cabinet, and brackets are provided on the inner, lower walls of the cabinet for releasably supporting the racks in the upper position and preventing their inadvertent removal; these brackets also support the rack in the lower, loading position.

4 Claims, 7 Drawing Figures

DISPLAY DEVICE OF THE TYPE HAVING RACKS ARRANGED IN SHINGLED FASHION

BACKGROUND OF THE INVENTION

The present invention relates to point of purchase display assemblies, and particularly to such devices which are used for merchandising cigarettes in retail sales establishments. Current merchandising units have several disadvantages that limit their conduciveness to planned and impulse sales. Important features of any such assemblies are compactness, capacity, accessibility of merchandise contained therein to customers, and aesthetic appeal. For example, some merchandisers have racks with vertical dividers thereon for dividing the racks into vertical rows, each of the rows containing one brand of cigarettes, stacked with the front panels of the adjacent packs abutting each other. The packs are singly removable by the customers at the columns' lower ends, and the capacity of such merchandisers are only limited by the height of the columns.

Other display devices have pin and bracket connections between the side walls of the cabinets in individual racks and some of these take rather complicated forms and are furthermore difficult to position the rack within the cabinet between loading and display positions.

SUMMARY OF THE INVENTION

The present invention provides a point-of-purchase merchandise display assembly having a support cabinet in which a plurality of merchandise racks are arranged in shingled and generally vertically positioned relationship. Means are provided for mounting the racks within the cabinet so as to permit their individual and selective sliding within the cabinet between a lower merchandise loading position and an upper display position. The mounting means provided by the present invention are particularly simple, foolproof in operation, and provide easy positioning of the racks between the upper display and lower loading positions.

These and other objectives and advantages of the present invention will appear as this disclosure progresses, reference being had to the accompanying drawings.

DESCRIPTION OF A PREFERRED EMBODIMENT

Figure 1:
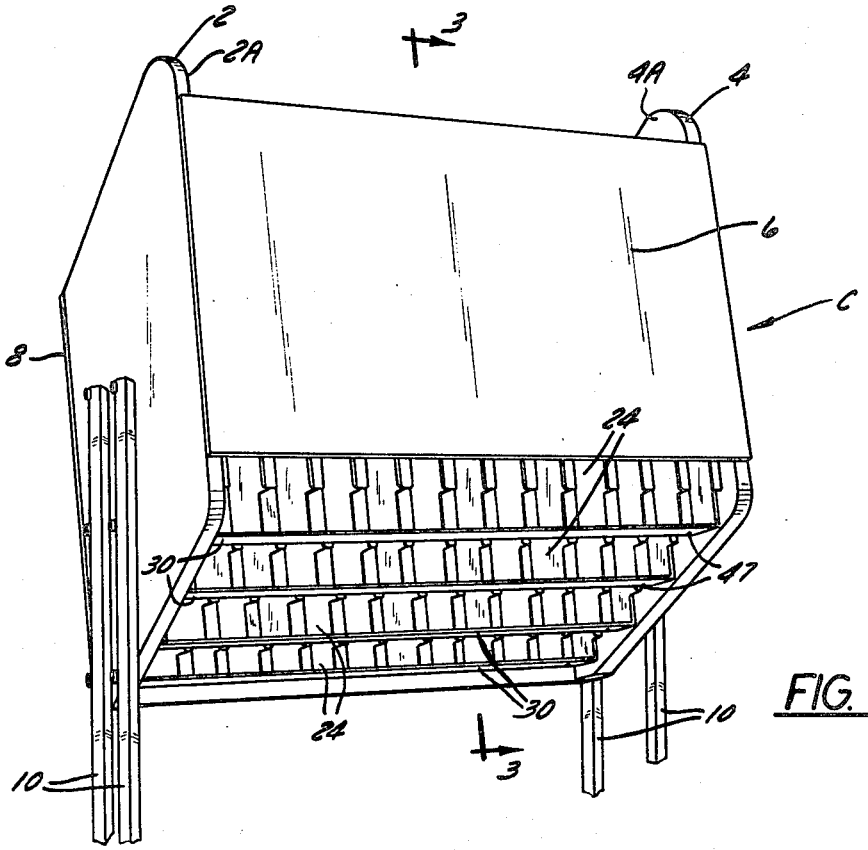
FIG. 1 is a perspective view of the display device made in accordance with the present invention and showing all of the shingled racks in the upper display position.

The assembly provided by the present invention includes a cabinet C having two spaced apart and generally vertically positioned side walls 2 and 4 which are connected together by the front panel 6 and a rear cross brace member 8. The cabinet is supported above the floor in any suitable manner and herein by legs 10 at each side.

The inner surfaces 2A and 4A of the side walls 2 and 4 have a series of parallel grooves 2B and 4B respectively in wall surfaces 2A and 4A. These grooves are arranged in generally vertical position, and the grooves in wall 2 are transversely aligned with the grooves in wall 4 so as to support racks 12, 14, 16 and 18 therebetween.

The racks 12, 14, 16 and 18 hold the merchandise within the assembly and in a ready-for-sale position. As these racks are similar in construction and function, only one will be described.

The rack is preferably fabricated of a rigid, impact-resistant material, such as by plastic injection molding to give a unit suitable for the shape of the merchandise to be contained therein. Rectangular-shaped racks are preferable for box-like units of merchandise, such as cigarette packs. The rack's rectangular shape is defined by two opposite, vertical side walls 20 and 22, a generally open front side 24 for access to and loading of merchandise, and a closed back side 26 opposite to the open side, the side walls 20 and 22 joining the closed and open sides. Spaced-apart upper and lower ends 28 and 30 integrally join the side walls.

Figure 2:
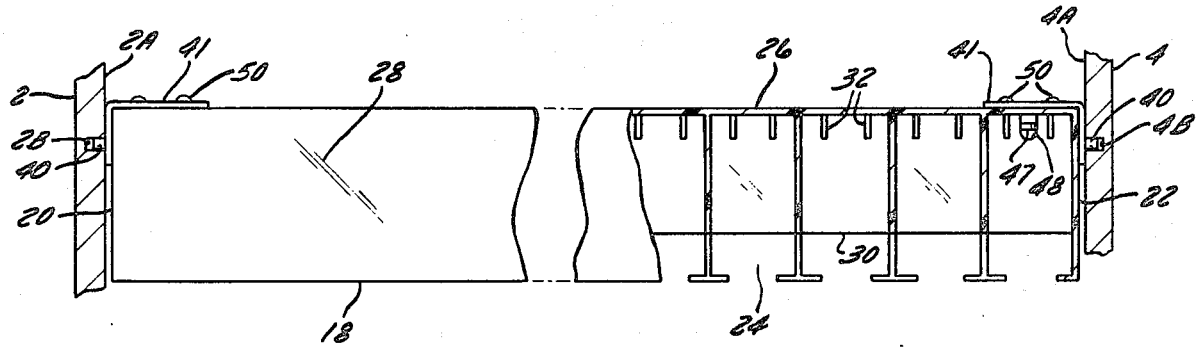
FIG. 2 is a plan view taken generally along line 2—2 in FIG. 3 but showing a portion of the rack as being in section or broken away.

Each rack, as is apparent from FIGS. 1 and 2, may be divided by vertically extending partitions into a plurality of side-by-side vertical compartments, each of which can contain a different brand of cigarettes.

Abutting and integrally molded to the closed back side 26 and lower end 28 in each vertical compartment is a pair of triangular displacement means 32 to cause the cigarette packs to be moved outwardly a small distance at the lower end and to thereby facilitate grasping the removal of the packs from the rack.

Figures 3, 4, 5:
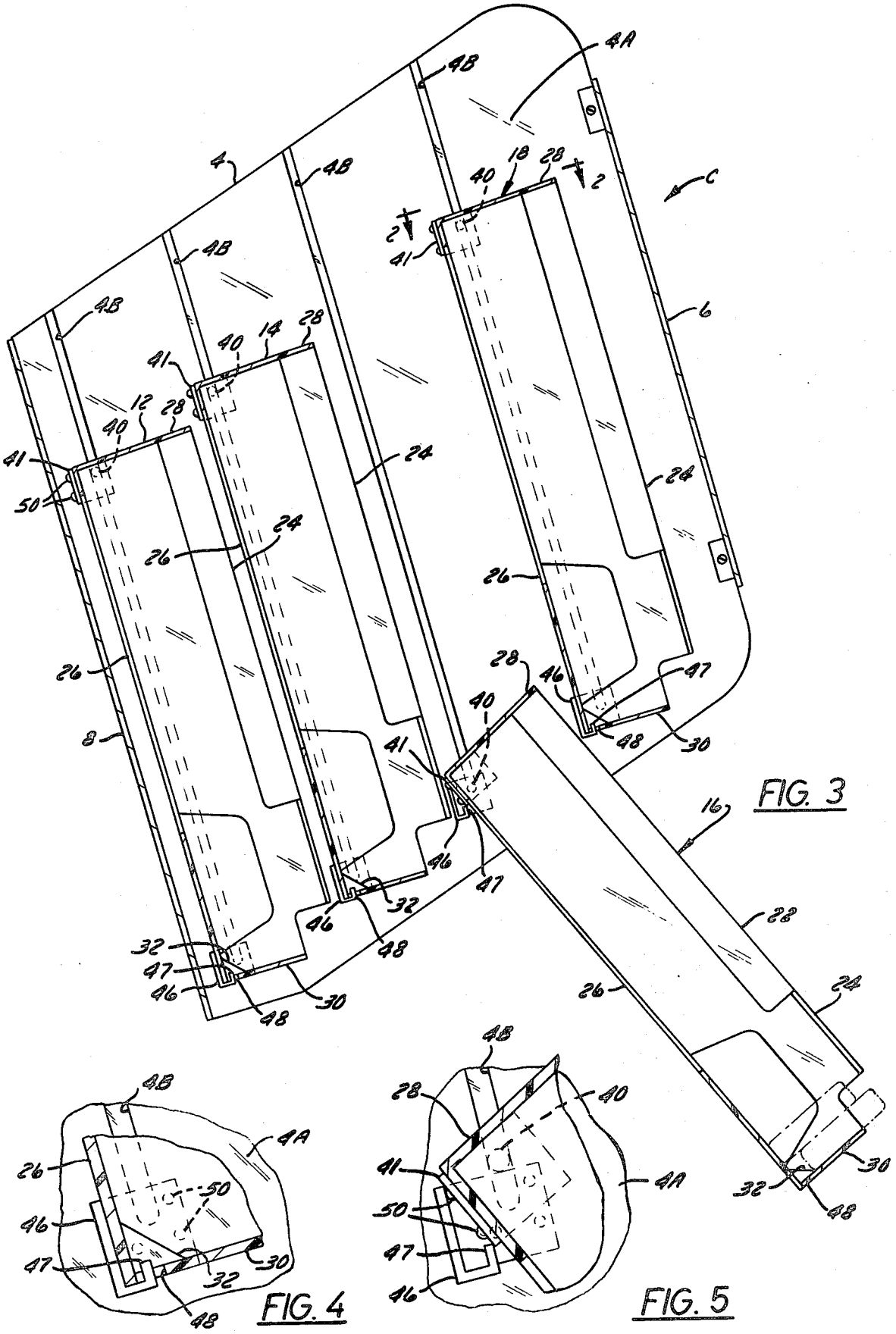
FIG. 3 is a vertical sectional view taken generally along line 3—3 in FIG. 1 but on an enlarged scale and furthermore showing one of the racks in the lower, loading position.
FIG. 4 is an enlarged fragmentary view of the racks shown in FIG. 3 when in the upper display position.
FIG. 5 is an enlarged fragmentary view of the lower clip supporting the rack when the latter is in the lower, loading position as shown by one of the racks in FIG. 3.
Figure 6:
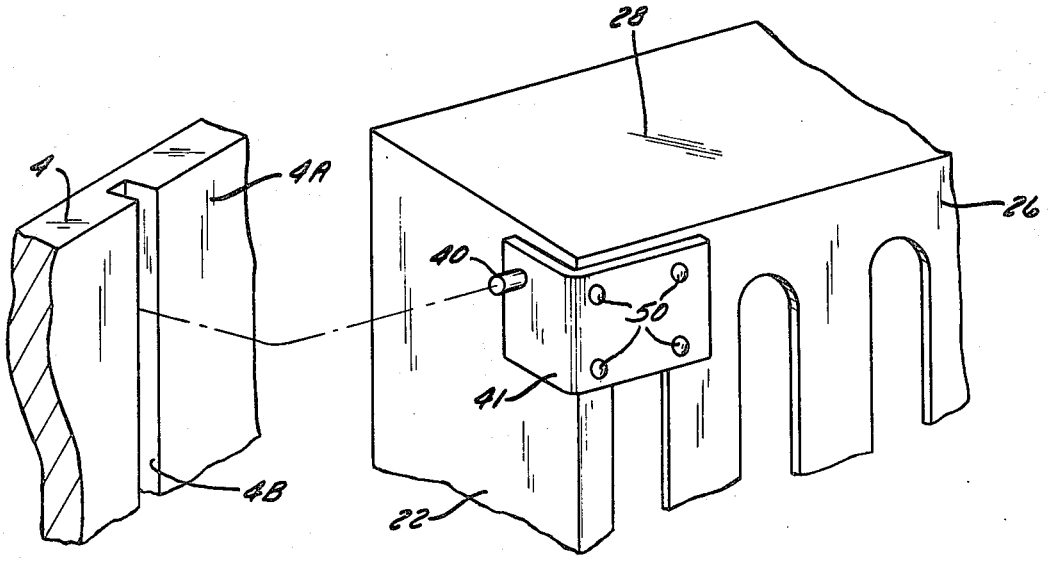
FIG. 6 is an enlarged fragmentary exploded view of an upper corner of one of the racks and also of a portion of the side frame having a guide groove for the pin of the rack.
Figure 7:
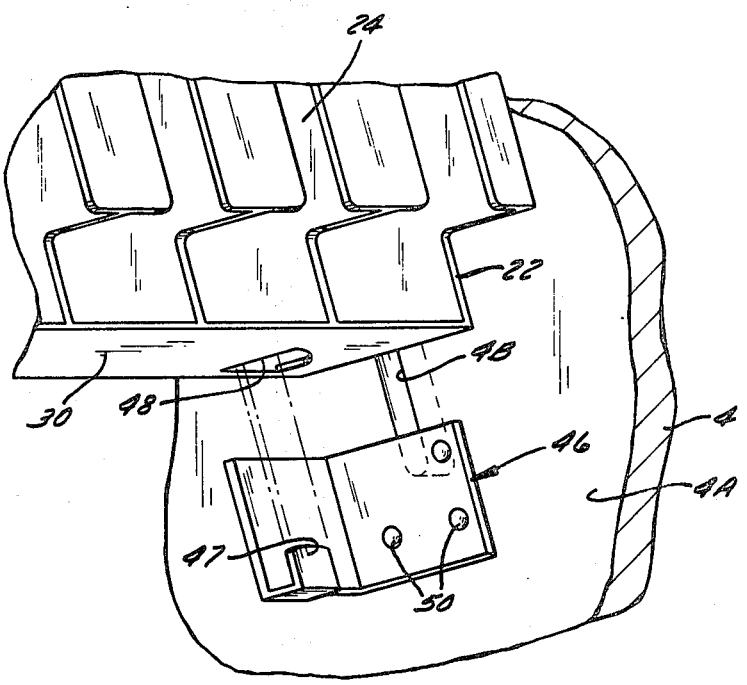
FIG. 7 is an enlarged fragmentary, perspective view of a portion of the lower corner of one of the racks and showing the lower corner hanger bracket as secured to the side walls of the cabinet and also showing the aperture in the lower end of the rack for receiving the corner bracket.

Means are provided for mounting the upper end of each rack between the side walls and for permitting the racks to slide in the grooves of the wall surfaces between a lower stocking position shown by rack 16 in FIG. 3 and an upper display position shown by the other racks in FIG. 3. This means includes the generally vertical position grooves in the inner side of each of the side walls. The means also includes a pin 40 and its bracket 41 extending from the upper end of the racks and outwardly of each side thereof, as clearly shown in FIG. 6. These pins extend into their respective grooves of the side walls and permit the racks to slide in the grooves between said lower and upper positions.

As shown in FIGS. 3, 4, 5 and 7, a metal bracket 46 is fixed to the cabinet near the lower end of each of the racks and at each lower corner thereof. These brackets 46 include an upwardly extending clip 47 having a free end which is adapted to be engaged in an aperture 48 which is formed in each lower corner of each rack. In this manner, when the racks are in the raised position shown in FIG. 3, the racks rest on the bracket 46 with the clip 47 engaged in the aperture 48 thus securing the rack in the cabinet and preventing its inadvertent shifting or removal from the cabinet. In order to slide the rack to the lower position for loading, it is only necessary to lift the rack and free it from the clip 47, pull the rack slightly forwardly and then lower the rack which simultaneously permits the pins to slide downwardly in their respective grooves in the side walls.

The clip brackets 46 and the pin brackets 41 are secured to the cabinet and to the plastic rack, respectively in any suitable manner, as by rivets or bolts 50.

As shown in FIG. 3, the rack is held in the lower, upwardly inclined position for loading by the upper bracket 41 which supportingly bear against bracket 46.

The entire cabinet is inclined forwardly at its lower end to facilitate viewing of the lower ends of the racks and grasping of the merchandise, and also to insure smooth sliding movement of the racks.

RECAPITULATION

The present invention provides a compact merchandise display assembly which is capable of holding a significant amount of merchandise and yet permits the easy removal thereof. The invention also permits the secure fastening of the racks within the cabinet and easy positioning of the racks in either the upper display position or lower loading position. There are no intricately shaped openings in the brackets which would othewise take time to align for adjusting the racks within the cabinet.

I claim:

1. A point of purchase merchandise display device comprising a cabinet that has laterally spaced upright and parallel side walls, and a plurality of merchandise supporting racks, each having top and bottom ends and extending laterally across said cabinet substantially from one to the other of its side walls, each said rack comprising a rear wall and laterally opposite side wall portions that project forwardly from said rear wall and are flatwise inwardly adjacent to said side walls of the cabinet, and each said rack being movable to and from a display position in the cabinet in which its rear wall extends in a near vertical but downwardly and forwardly inclined direction, said racks when in their display positions being disposed one behind the other and at elevations such that their several bottom ends are stepped downwardly and rearwardly to have merchandise in the bottom portion of every rack accessible for forward removal therefrom, said display device being characterized by:

A. each of said side walls of the cabinet having in its surface that opposes the other a groove for each of said racks, each said groove extending in said direction and the two grooves for each rack being opposite and opening toward one another;

B. a pair of coaxial pins on each rack, each projecting laterally outwardly from one of said side wall portions of the rack, said pins being slideably received in said grooves for the rack and each said pin being located near the top of the rack and forwardly adjacent to said rear wall of the rack; and C. a pair of brackets for each rack, one for each side of the rack, each said bracket having (1) an attachment portion secured to the side wall of the cabinet at its side of the rack, (2) a back supporting portion projecting laterally inwardly from the cabinet side wall to which the bracket is secured, rearwardly adjacent to the bottom of the groove for its rack, and against which the back wall of its rack is engageable, and (3) a hook-like clip portion which projects forward and upward from said back supporting portion and which is engageable with a bottom edge portion of the rear wall of the rack to cooperate with the pins and said back supporting portion in maintaining the rack in its display position, the rack being disengageable from said clip portion by lifting and forward motion of its bottom end so that the rack can be lowered to a stocking position in which its pins are near its brackets and the clip portions of its brackets engage the rear surface of its rear wall.

2. The display device of claim 1 wherein each of said grooves extends to the top edge of the cabinet side wall so that the racks can be inserted into the cabinet from above the same.

3. The display device of claim 1 wherein said cabinet has a front wall extending from one to the other of its side walls, said front wall having a top edge which is at a level at least as high as that of the top ends of the racks and having a bottom edge which is above the level of the bottom ends of all of the racks.

4. The display device of claim 1 wherein each said rack has a bottom wall, and each said bottom wall has a hole therein which is adjacent to the rear wall of the rack and in which said clip portion of a bracket can project upwardly.

* * * * *